US012072129B2

(12) United States Patent
Tsuji et al.

(10) Patent No.: US 12,072,129 B2
(45) Date of Patent: Aug. 27, 2024

(54) INDOOR UNIT OF REFRIGERATION APPARATUS

(71) Applicant: DAIKIN INDUSTRIES, LTD., Osaka (JP)

(72) Inventors: Yoshiyuki Tsuji, Osaka (JP); Makoto Kojima, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 17/573,043

(22) Filed: Jan. 11, 2022

(65) Prior Publication Data

US 2022/0128281 A1 Apr. 28, 2022

Related U.S. Application Data

(63) Continuation of application No. PCT/JP2020/026437, filed on Jul. 6, 2020.

(30) Foreign Application Priority Data

Jul. 12, 2019 (JP) ..... 2019-130646

(51) Int. Cl.
*F25B 49/00* (2006.01)
*F24F 1/0047* (2019.01)
(Continued)

(52) U.S. Cl.
CPC ..... *F25B 49/005* (2013.01); *F24F 1/0047* (2019.02); *F24F 11/30* (2018.01);
(Continued)

(58) Field of Classification Search
CPC . F25B 49/005; F25B 2500/222; F24F 1/0047; F24F 11/30; F24F 2221/14; F24F 8/10; F24F 13/222
See application file for complete search history.

(56) References Cited

U.S. PATENT DOCUMENTS 4,747,791 A * 5/1988 Nishio ..... H01R 13/514 439/638
2017/0198936 A1* 7/2017 Yamaguchi ..... F24F 11/74
(Continued)

FOREIGN PATENT DOCUMENTS

CN 101418965 A 4/2009
EP 3901526 A1 * 10/2021
(Continued)

OTHER PUBLICATIONS

International Preliminary Report on Patentability issued in corresponding International Application No. PCT/JP2020/026437 mailed Jan. 27, 2022 (7 pages).
(Continued)

*Primary Examiner* — Kun Kai Ma
(74) *Attorney, Agent, or Firm* — Osha Bergman Watanabe & Burton LLP

(57) ABSTRACT

An indoor unit of a refrigeration apparatus, to be disposed in a ceiling, includes a casing that has blow-out ports and a blow-in port disposed in a lower surface, a plate-shaped member disposed below the blow-in port, and a filter disposed above an opening in the plate-shaped member. The casing accommodates a heat exchanger, a control board, a support member supporting the control board, and a gas sensor disposed at or adjacent to the support member and between the casing and the plate-shaped member. The gas sensor detects the refrigerant flowing out of the blow-in port due to refrigerant leakage, and the gas sensor is removable when the plate-shaped member is shifted.

10 Claims, 8 Drawing Sheets

(51) Int. Cl.
*F24F 8/10* (2021.01)
*F24F 11/30* (2018.01)
*F24F 13/22* (2006.01)

(52) U.S. Cl.
CPC ..... *F24F 8/10* (2021.01); *F24F 13/222* (2013.01); *F24F 2221/14* (2013.01); *F25B 2500/222* (2013.01)

(56) References Cited

U.S. PATENT DOCUMENTS

| | | | | |
|---|---|---|---|---|
| 2017/0336092 | A1 | 11/2017 | Ikawa et al. | |
| 2018/0017293 | A1* | 1/2018 | Naito | F25B 49/02 |
| 2018/0283718 | A1 | 10/2018 | Honda et al. | |
| 2018/0313591 | A1 | 11/2018 | Obara et al. | |
| 2020/0393140 | A1 | 12/2020 | Nouchi | |
| 2021/0018200 | A1* | 1/2021 | Watanabe | F24F 11/64 |

FOREIGN PATENT DOCUMENTS

| | | | | | |
|---|---|---|---|---|---|
| JP | H10115478 | A | | 5/1998 | |
| JP | 2012220163 | A | | 11/2012 | |
| JP | 2013088086 | A | | 5/2013 | |
| JP | 2014081160 | A | | 5/2014 | |
| JP | 2014224612 | A | | 12/2014 | |
| JP | 2015017802 | A | | 1/2015 | |
| JP | 2016084946 | A | | 5/2016 | |
| JP | 2016090108 | A | | 5/2016 | |
| JP | 2016176648 | A | * | 10/2016 | F24F 1/0059 |
| JP | 2017015324 | A | | 1/2017 | |
| JP | 2017020766 | A | | 1/2017 | |
| JP | 2017067533 | A | * | 4/2017 | G01N 27/028 |
| JP | 2019011914 | A | | 1/2019 | |
| JP | 2019060517 | A | | 4/2019 | |
| WO | 2016/158847 | A1 | | 10/2016 | |
| WO | 2017/110904 | A1 | | 6/2017 | |
| WO | 2019/013049 | A1 | | 1/2019 | |
| WO | WO-2019234902 | A1 | * | 12/2019 | |

OTHER PUBLICATIONS

International Search Report issued in corresponding International Application No. PCT/JP2020/06437, mailed on Sep. 24, 2020 (7 pages).

Decision to Grant issued in Japanese Patent Application No. 2019-130646, mailed on Jun. 29, 2021 (5 pages).

Decision of Refusal issued in Japanese Patent Application No. 2019-130646, mailed on Feb. 9, 2021 (10 pages).

Extended European Search Report issued in corresponding European Patent Application No. EP 20840388.1 dated Jul. 27, 2022 (9 pages).

* cited by examiner

INDOOR UNIT OF REFRIGERATION APPARATUS

CROSS-REFERENCE TO RELATED APPLICATIONS

This is a continuation application of International Patent Application No. PCT/JP2020/026437, filed on Jul. 6, 2020, and claims priority to Japanese Patent Application No. 2019-130646, filed on Jul. 12, 2019. The content of these priority applications are incorporated herein by reference.

TECHNICAL FIELD

The present disclosure relates to an indoor unit of a refrigeration apparatus configured to detect refrigerant leakage.

BACKGROUND

In recent years, air conditioners adopting refrigerants having low global warming potential (GWP) (hereinafter, called low GWP refrigerants) in view of environmental protection. Examples of the low GWP refrigerants include a refrigerant disclosed in Patent Literature 1 (JP 2019-11914 A).

SUMMARY

An indoor unit of a refrigeration apparatus, according to one or more embodiments of the invention, is to be installed in a ceiling, and includes a casing and a plate-shaped member. The casing has a plurality of blow-out ports and a blow-in port provided in a lower surface. The plate-shaped member is installed below the blow-in port. The casing accommodates a heat exchanger, a control board, a support member, and a gas sensor. The heat exchanger allows a refrigerant larger in specific gravity than air to flow therein. The support member supports the control board. The gas sensor is installed at or adjacent to the support member, and detects refrigerant leakage. The gas sensor is removable when the plate-shaped member is shifted.

DETAILED DESCRIPTION

(1) Air Conditioner 10

Description is made herein to an air conditioner 10 as an exemplary refrigeration apparatus.

Figure 1:
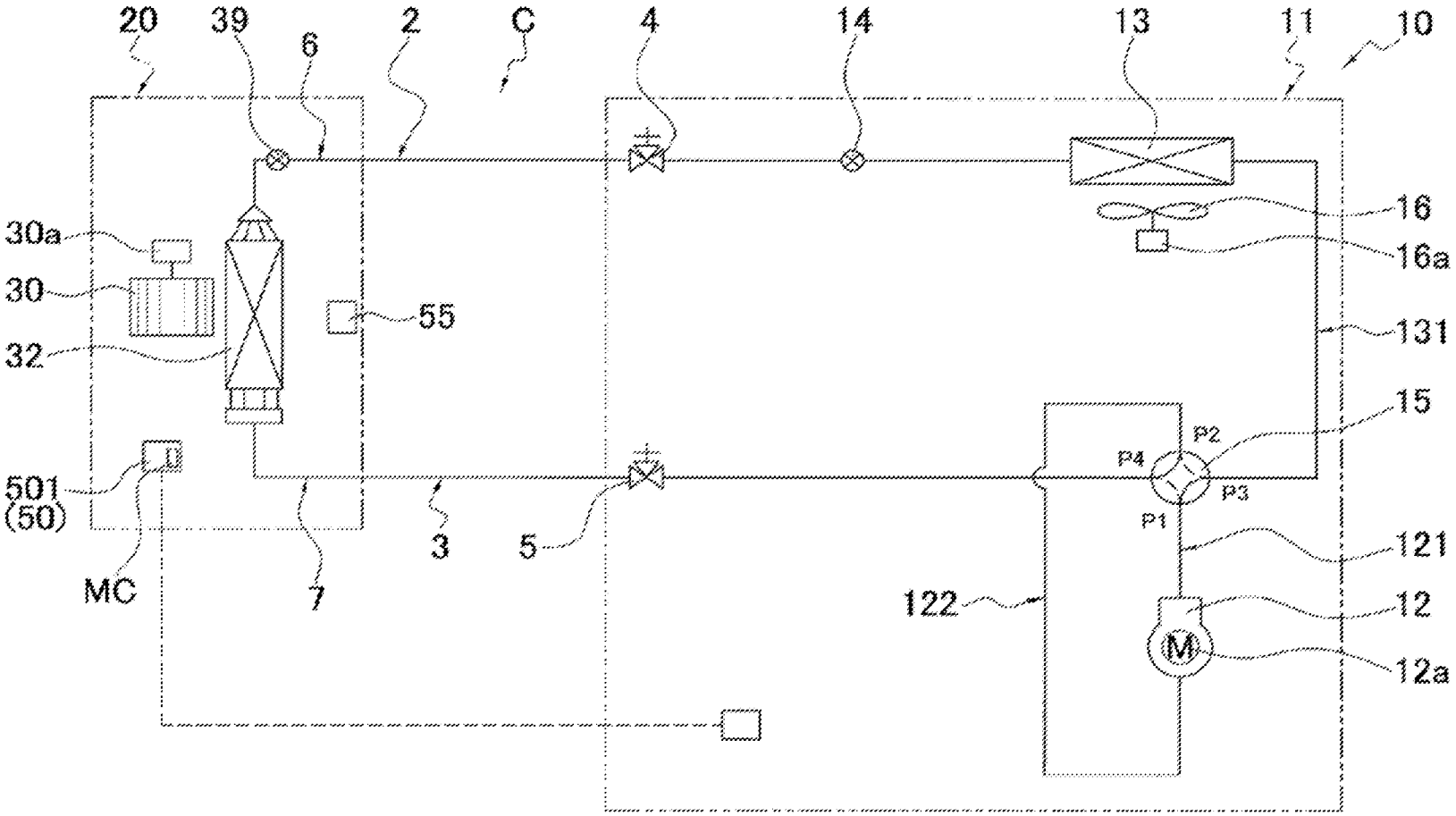
FIG. 1 is a piping diagram depicting a configuration of a refrigerant circuit in an air conditioner according to an embodiment of the present disclosure.

FIG. 1 is a piping diagram depicting a configuration of a refrigerant circuit C in the air conditioner 10, according to one or more embodiments of the present disclosure. The air conditioner 10 depicted in FIG. 1 cools and heats air in a room. As depicted in FIG. 1, the air conditioner 10 includes an outdoor unit 11 disposed outdoors and an indoor unit 20 installed in the room. The outdoor unit 11 and the indoor unit 20 are connected to each other by two connection pipes 2 and 3. The refrigerant circuit C is accordingly constituted in the air conditioner 10. The refrigerant circuit C is filled with a refrigerant that circulates to achieve a vapor compression refrigeration cycle.

(1-1) Outdoor Unit 11

The outdoor unit 11 is provided with a compressor 12, an outdoor heat exchanger 13, an outdoor expansion valve 14, and a four-way switching valve 15.

(1-1-1) Compressor 12

The compressor 12 compresses a low-pressure refrigerant and discharges a high-pressure refrigerant obtained by compression. The compressor 12 includes a compression mechanism of a scroll type, a rotary type, or the like driven by a compressor motor 12*a*. The compressor motor 12*a* has an operating frequency variable by means of an inverter device.

As depicted in FIG. 1, there is provided a discharge pipe 121 connecting a refrigerant discharge port of the compressor 12 and the four-way switching valve 15. There is further provided a suction pipe 122 connecting a suction port of the compressor 12 and the four-way switching valve 15.

(1-1-2) Outdoor Heat Exchanger 13

The outdoor heat exchanger 13 is of a fin and tube type. There is installed an outdoor fan 16 adjacent to the outdoor heat exchanger 13. The outdoor heat exchanger 13 causes heat exchange between air conveyed by the outdoor fan 16 and a refrigerant flowing in the outdoor heat exchanger 13.

As depicted in FIG. 1, there is provided a first pipe 131 connecting a refrigerant inflow port of the outdoor heat exchanger 13 and the four-way switching valve 15 during cooling operation.

(1-1-3) Outdoor Expansion Valve 14

The outdoor expansion valve 14 is an electronic expansion valve having a variable opening degree. The outdoor expansion valve 14 is installed downstream of the outdoor heat exchanger 13 in a refrigerant flow direction in the refrigerant circuit C during cooling operation.

The opening degree of the outdoor expansion valve 14 is fully opened during cooling operation. In contrast, during heating operation, the opening degree of the outdoor expansion valve 14 is adjusted such that a refrigerant flowing into the outdoor heat exchanger 13 is decompressed to pressure enabling evaporation (evaporation pressure) in the outdoor heat exchanger 13.

(1-1-4) Four-Way Switching Valve 15

The four-way switching valve 15 has first to fourth ports. At the four-way switching valve 15, a first port P1 is connected to the discharge pipe 121 of the compressor 12, a second port P2 is connected to the suction pipe 122 of the compressor 12, a third port P3 is connected to the first pipe 131 of the outdoor heat exchanger 13, and a fourth port P4 is connected to a gas shutoff valve 5.

The four-way switching valve 15 is switched between a first state (state indicated by solid lines in FIG. 1) and a second state (state indicated by broken lines in FIG. 1). At the four-way switching valve 15 in the first state, the first port P1 and the third port P3 communicate with each other and the second port P2 and the fourth port P4 communicate with each other. At the four-way switching valve 15 in the second state, the first port P1 and the fourth port P4 communicate with each other and the second port P2 and the third port P3 communicate with each other.

(1-1-5) Outdoor Fan 16

The outdoor fan 16 is constituted as a propeller fan driven by an outdoor fan motor 16*a*. An operating frequency of the outdoor fan motor 16*a* is variable by means of an inverter device.

(1-1-6) Liquid Connection Pipe 2 and Gas Connection Pipe 3

The two connection pipes include the liquid connection pipe 2 and the gas connection pipe 3. The liquid connection pipe 2 has a first end connected to a liquid shutoff valve 4 and a second end connected to a liquid connecting pipe 6 of an indoor heat exchanger 32. As depicted in FIG. 1, the liquid connecting pipe 6 is connected directly or indirectly to a refrigerant inlet of the indoor heat exchanger 32 during cooling operation.

The gas connection pipe 3 has a first end connected to the gas shutoff valve 5 and a second end connected to a gas connecting pipe 7 of the indoor heat exchanger 32. As depicted in FIG. 1, the gas connecting pipe 7 is connected directly or indirectly to a refrigerant outlet of the indoor heat exchanger 32 during cooling operation.

(1-2) Indoor Unit 20

Figure 2:
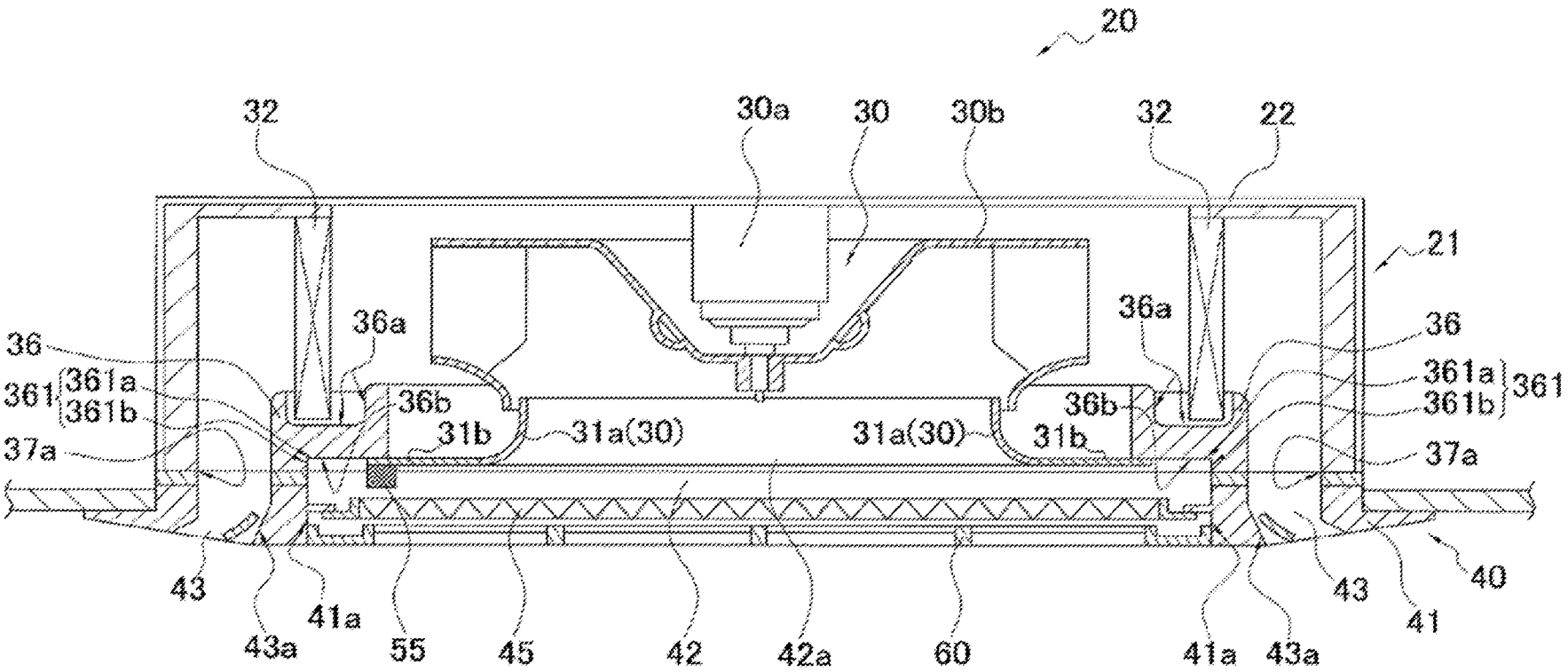
FIG. 2 is a longitudinal sectional view of an indoor unit of the air conditioner.
Figure 3:
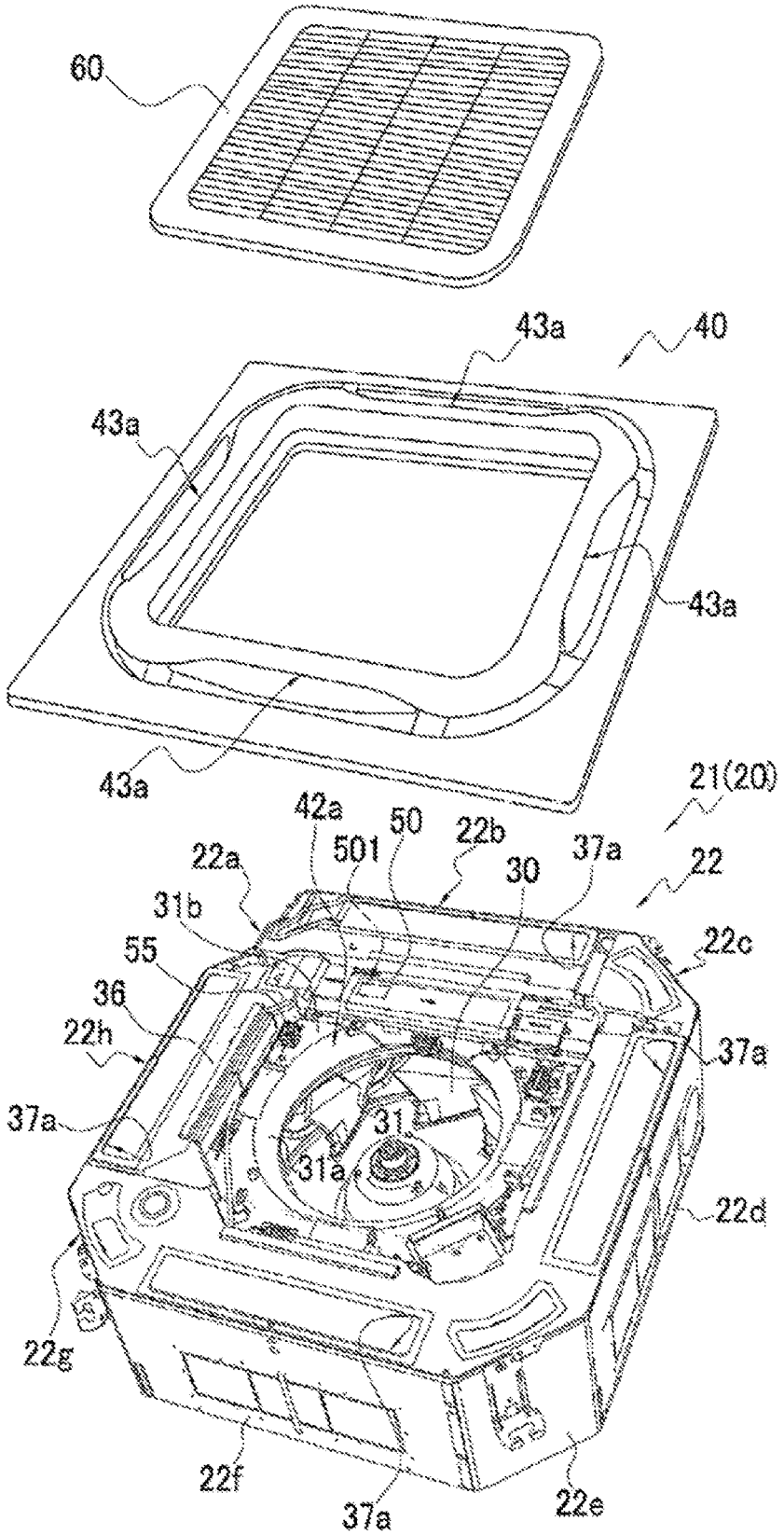
FIG. 3 is a perspective view from an air blow-in side, of the indoor unit with a decorative panel being separated.
Figure 4A:
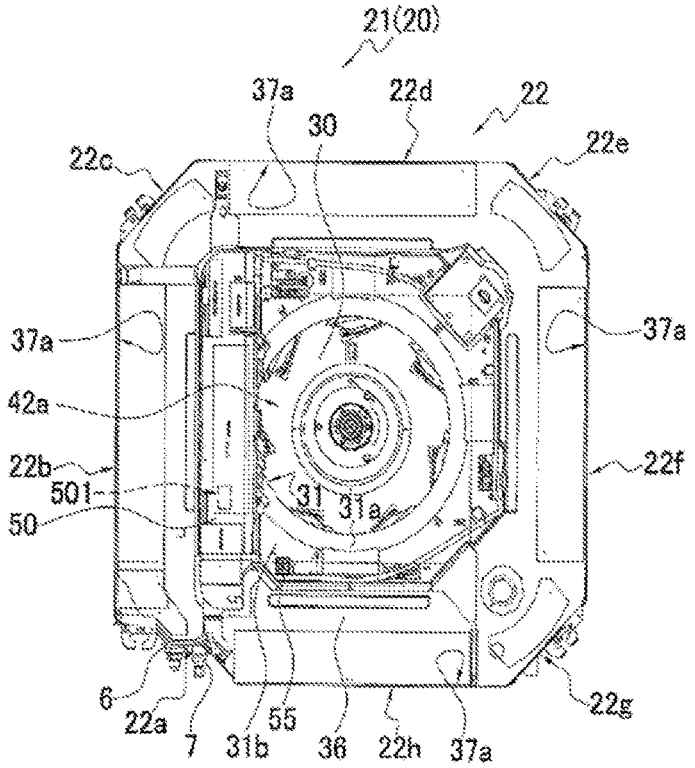
FIG. 4A is a plan view from the air blow-in side, of the indoor unit with the decorative panel being separated.

FIG. 2 is a longitudinal sectional view of the indoor unit 20 of the air conditioner 10. FIG. 3 is a perspective view from an air blow-in side, of the indoor unit 20 with a decorative panel being separated. FIG. 4A is a plan view from the air blow-in side, of the indoor unit 20 with a decorative panel 40 being separated.

In FIG. 2, FIG. 3, and FIG. 4A, the indoor unit 20, according to one or more embodiments, is of a ceiling embedded type. The indoor unit 20 includes a body 21, and the decorative panel 40 attached to a bottom of the body 21.

As depicted in FIG. 2 and FIG. 3, the body 21 includes a casing 22, the indoor heat exchanger 32, an indoor expansion valve 39, an indoor fan 30, and a gas sensor 55.

The decorative panel 40 is attached to the bottom of the body 21. The decorative panel 40 includes a panel portion 41 and a suction grill 60.

The panel portion 41 is provided with a single blow-in flow path 42 and four blow-out flow paths 43. As depicted in FIG. 2, the blow-in flow path 42 is provided at a center of the panel portion 41. The body 21 and the blow-in flow path 42 interpose a blow-in port 42*a*. The blow-in flow path 42 in the panel portion 41 has a lower end provided with an opening 41*a* corresponding to the blow-in port 42*a*.

The opening 41*a* has a quadrilateral shape in a planar view, and the suction grill 60 is attached to prevent an interior of the indoor unit 20 from being visible via the opening 41*a*.

The opening 41*a* and the blow-in port 42*a* interpose a filter 45 configured to capture dust in air sucked via the opening 41*a*.

The blow-out flow paths 43 are provided outside the blow-in flow path 42 to surround the blow-in flow path 42. The blow-out flow paths 43 respectively extend along four sides of the blow-in flow path 42. The body 21 and each of the blow-out flow paths 43 interpose a blow-out port 37*a*. The blow-out flow paths 43 in the panel portion 41 each have a lower end provided with an opening 43*a* corresponding to the blow-out port 37*a*.

(1-2-1) Casing 22

The casing 22 has a plurality of side walls, and has an octagonal shape obtained by alternately connecting four short sides and four long sides in a planar view. FIG. 4A depicts a first short side wall 22*a* as a side wall penetrated by the liquid connecting pipe 6 and the gas connecting pipe 7 connected to the indoor heat exchanger 32. The first short side wall 22*a* has a portion that is penetrated by the liquid connecting pipe 6 and the gas connecting pipe 7 and is bent to be perpendicular to the pipes.

FIG. 4A depicts a first long side wall 22*b*, a second short side wall 22*c*, a second long side wall 22*d*, a third short side wall 22*e*, a third long side wall 22*f*, a fourth short side wall 22*g*, and a fourth long side wall 22*h*, which are disposed clockwise from the first short side wall 22*a*.

Figure 4B:
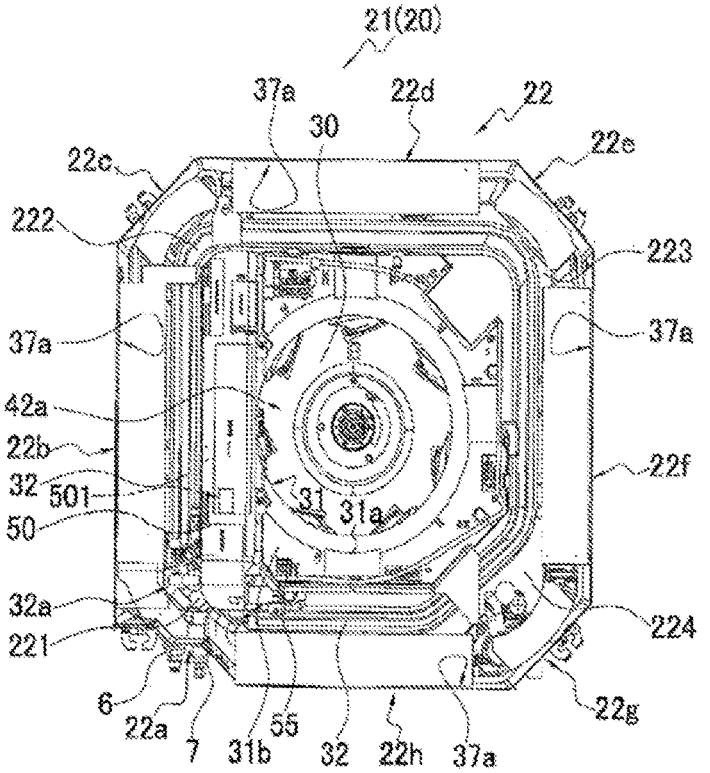
FIG. 4B is a plan view from a blow-in port, of the indoor unit with the decorative panel and a drain pan being separated.

FIG. 4B is a plan view from the blow-in port 42*a*, of the indoor unit 20 with a drain pan 36 being separated from a state of FIG. 4A. The plurality of side walls depicted in FIG. 4B forms a first corner 221, a second corner 222, a third corner 223, and a fourth corner 224 in the casing 22.

The first corner 221 is formed by the first long side wall 22*b* and the fourth long side wall 22*h*, faces the first short side wall 22*a*, and an end part 32*a* of the indoor heat exchanger 32 is installed at the first corner 221.

The end part of the indoor heat exchanger 32 is connected with the liquid connecting pipe 6 and the gas connecting pipe 7 that penetrate the first short side wall 22*a* as described above. The liquid connecting pipe 6 is connected with the liquid connection pipe 2 and the gas connecting pipe 7 is connected with the gas connection pipe 3.

The casing 22 accommodates the indoor fan 30, a bell mouth 31, the indoor heat exchanger 32, and the drain pan 36.

(1-2-2) Indoor Fan 30

The indoor fan 30 is a centrifugal fan driven by an indoor fan motor 30*a*. An operating frequency of the indoor fan motor 30*a* is variable by means of an inverter device.

As depicted in FIG. 3, FIG. 4A, and FIG. 4B, the indoor fan 30 is disposed at a center in the casing 22. The indoor fan 30 includes the indoor fan motor 30*a* and an impeller 30*b*. The indoor fan motor 30*a* is supported by a top panel of the casing 22. The impeller 30*b* is constituted by a plurality of turbo wings arranged in a rotation direction of a drive shaft.

(1-2-3) Bell Mouth 31

The bell mouth 31 is disposed below the indoor fan 30. The bell mouth 31 has a circular opening at each of upper and lower ends, and has a tubular shape with an opening area gradually increased toward the decorative panel 40. The bell mouth 31 has an arc surface that smoothly connects from the upper end to the lower end and the portion forming the arc surface is called an arc plate 31*a*.

The bell mouth 31 has an internal space communicating with an accommodation space of the indoor fan 30. The bell mouth 31 can thus guide air introduced from the opening 41*a* via the blow-in port 42*a* into the indoor unit 20.

(1-2-4) Indoor Heat Exchanger 32

The indoor heat exchanger 32 is of a fin and tube type. The indoor heat exchanger 32 is installed adjacent to the indoor fan 30. As depicted in FIG. 4A and FIG. 4B, the indoor heat exchanger 32 includes a heat transfer tube bent to surround the indoor fan 30.

The indoor heat exchanger 32 is installed on an upper surface of the drain pan 36 to rise upward. The indoor heat exchanger 32 allows passage of air blown laterally from the indoor fan 30. The indoor heat exchanger 32 constitutes an evaporator configured to cool air during cooling operation, and constitutes a radiator configured to heat air during heating operation.

(1-2-5) Drain Pan 36

The drain pan 36 is installed around the bell mouth 31. The indoor heat exchanger 32 is installed above the drain pan 36 that receives water condensed by the indoor heat exchanger 32 and falling downward. The drain pan 36 has a first surface 36*a* facing a bottom of the indoor heat exchanger 32, and a second surface 36*b* other than the first surface 36*a*.

(1-2-6) Indoor Expansion Valve 39

The indoor expansion valve 39 is connected to a liquid end part of the indoor heat exchanger 32 in the refrigerant circuit C. The indoor expansion valve 39 is constituted by an electronic expansion valve having a variable opening degree.

(1-2-7) Electric Component Box 50

The casing 22 accommodates an electric component box 50. The electric component box 50 is installed at a position visible by a user or a service person when the user or the service person shifts the suction grill 60.

Specifically, the electric component box 50 is installed along at least one of the first long side wall 22*b* and the fourth long side wall 22*h* forming the first corner 221 of the casing 22.

The electric component box 50 accommodates a control board 501 that is also disposed along at least one of the first long side wall 22*b* and the fourth long side wall 22*h* forming the first corner 221 of the casing 22.

The control board 501 is equipped with a microcomputer MC that is configured to determine whether or not a refrigerant is leaking in accordance with a signal inputted from the gas sensor 55 or the like.

(1-2-8) Gas Sensor 55

Figure 5A:
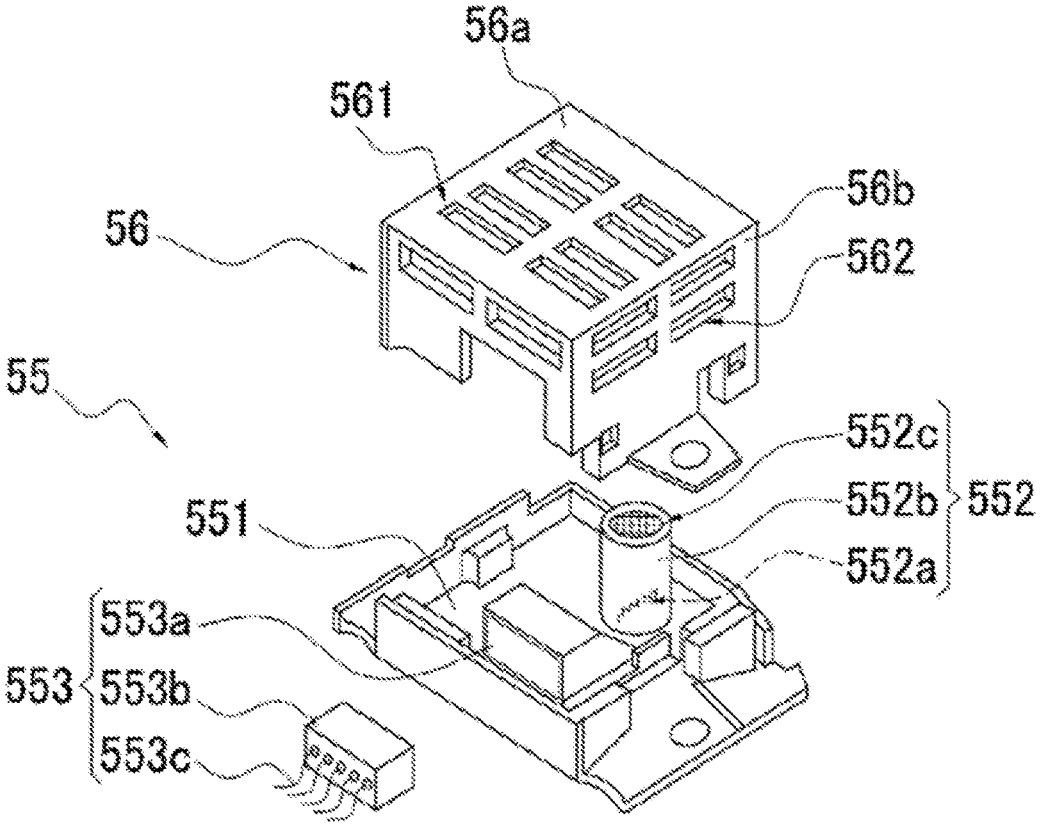
FIG. 5A is a perspective view of a gas sensor to be covered with a case.
Figure 5B:
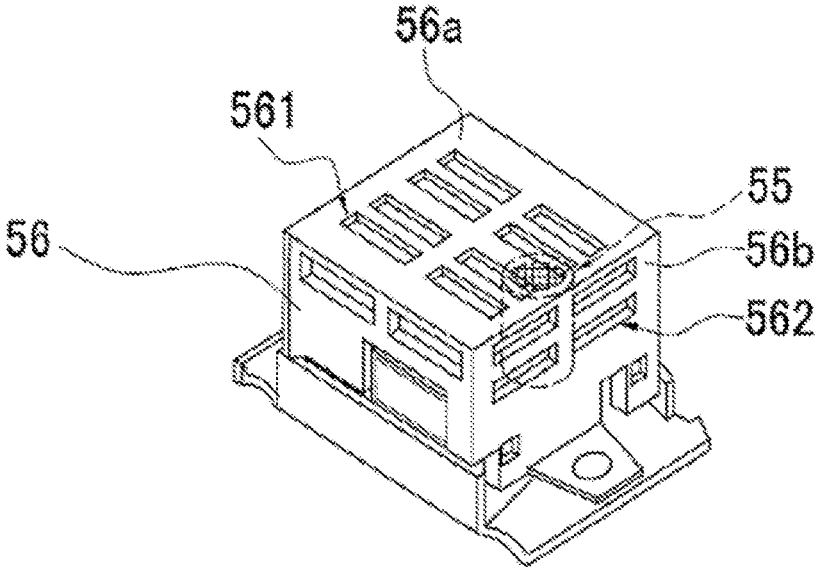
FIG. 5B is a perspective view of the gas sensor covered with the case.

FIG. 5A is a perspective view of the gas sensor 55 to be covered with a case 56. FIG. 5B is a perspective view of the gas sensor 55 covered with the case 56. The gas sensor 55 depicted in FIG. 5A and FIG. 5B detects refrigerant leakage. The gas sensor 55 includes a substrate 551, a sensor unit 552, and a wiring unit 553. The sensor unit 552 includes a sensor element 552*a*, and a cylindrical pipe 552*b* covering the sensor element 552*a*.

The sensor element 552*a* is mounted on the substrate 551 and detects whether or not there is refrigerant gas. The cylindrical pipe 552*b* has an upper end surface provided with a hole 552*c* allowing entry of refrigerant gas.

The wiring unit 553 includes a female connector 553*a* mounted on the substrate 551, a male connector 553*b* inserted to the female connector 553*a*, and a cable 553*c* connected to the male connector 553*b*. The wiring unit 553 electrically connects the sensor element 552*a* and the control board 551.

At least the sensor unit 552 of the gas sensor 55 is covered with the protective case 56. The case 56 has a first opening 561 for ventilation. The first opening 561 is provided in a surface called a ventilation surface 56*a*.

The ventilation surface 56*a*, according to one or more embodiments, crosses a side surface 56*b* provided with a second opening 562.

When a refrigerant leaks, part of refrigerant gas entered via the first opening 561 can flow to the sensor unit 552 of the gas sensor 55 and the remaining can exit via the second opening 562. Alternatively, when the refrigerant leaks, part of refrigerant gas entered via the second opening 562 can flow to the sensor unit 552 of the gas sensor 55 and the remaining can exit via the first opening 561.

According to one or more embodiments, the ventilation surface 56*a* has a plurality of first openings 561 and the side surface 56*b* has a plurality of second openings 562. There may alternatively be provided a single first opening 561 and a single second opening 562.

The case 56 exerts two functions of protecting the sensor unit 552 and introducing refrigerant gas as a leaking refrigerant.

(2) Operation

The air conditioner 10 according to one or more embodiments will be described next in terms of its operation. The air conditioner 10 switchingly executes cooling operation and heating operation.

(2-1) Cooling Operation

During cooling operation, the four-way switching valve 15 depicted in FIG. 1 is in the state indicated by solid lines, and the compressor 12, the indoor fan 30, and the outdoor fan 16 are in an operating state. The refrigerant circuit C thus achieves a refrigeration cycle in which the outdoor heat exchanger 13 functions as a radiator and the indoor heat exchanger 32 functions as an evaporator.

Specifically, a high pressure refrigerant compressed by the compressor 12 flows in the outdoor heat exchanger 13 to exchange heat with outdoor air. The high pressure refrigerant radiates heat to the outdoor air in the outdoor heat exchanger 13. A refrigerant condensed by the outdoor heat exchanger 13 is sent to the indoor unit 20. The refrigerant in the indoor unit 20 is decompressed by the indoor expansion valve 39 and then flows in the indoor heat exchanger 32.

In the indoor unit 20, indoor air blown out of the indoor fan 30 passes the indoor heat exchanger 32 to exchange heat with the refrigerant. The refrigerant in the indoor heat exchanger 32 is evaporated by absorbing heat from the indoor air. The indoor air is cooled by the refrigerant.

The air cooled by the indoor heat exchanger 32 is supplied into an indoor space. The refrigerant evaporated in the indoor heat exchanger 32 is sucked into the compressor 12 to be compressed again.

(2-2) Heating Operation

During heating operation, the four-way switching valve 15 depicted in FIG. 1 is in the state indicated by broken lines, and the compressor 12, the indoor fan 30, and the outdoor fan 16 are in the operating state. The refrigerant circuit C thus achieves a refrigeration cycle in which the indoor heat exchanger 32 functions as a condenser and the outdoor heat exchanger 13 functions as an evaporator.

Specifically, a high pressure refrigerant compressed by the compressor 12 flows in the indoor heat exchanger 32 of the indoor unit 20. In the indoor unit 20, indoor air blown out of the indoor fan 30 passes the indoor heat exchanger 32 to exchange heat with the refrigerant. The refrigerant in the indoor heat exchanger 32 is condensed by radiating heat to the indoor air. The indoor air is heated by the refrigerant.

The air heated in the indoor heat exchanger 32 is supplied into the indoor space. The refrigerant condensed in the indoor heat exchanger 32 is decompressed by the outdoor expansion valve 14 and then flows in the outdoor heat exchanger 13. The refrigerant in the outdoor heat exchanger 13 absorbs heat from outdoor air to be evaporated. The refrigerant evaporated in the outdoor heat exchanger 13 is sucked into the compressor 12 to be compressed again.

(3) Location of Gas Sensor 55

(3-1) Location Details

The gas sensor 55 is accommodated in the casing 22, but is positioned to be removable when the suction grill 60 is shifted. Specifically, the gas sensor 55 is installed at the second surface 36*b* of the drain pan 36 so as to be adjacent to the electric component box 50.

The second surface 36*b* of the drain pan 36 corresponds to the surface excluding the first surface 36*a* facing the bottom of the indoor heat exchanger 32. In view of maintainability for replacement of the gas sensor 55, the second surface 36*b* is desirably displaced along the blow-in port 42*a*.

One or more embodiments include a flat plate 31*b* disposed adjacent to a lower end of the arc plate 31*a* of the bell mouth 31 so as to surround the lower end. The flat plate 31*b* is positioned below a bottom wall of the drain pan 36. In order to avoid interference between the flat plate 31*b* and the bottom wall of the drain pan 36, the bottom wall of the drain pan 36 has a step 361 to be in contact with the flat plate 31*b*.

The step 361 (FIG. 1) includes a horizontal plane 361*a* in contact with an end part of the flat plate 31*b*, and a vertical plane 361*b* standing vertically downward from a terminal end of the horizontal plane 361*a*.

The gas sensor 55 is positioned adjacent to the electric component box 50 as depicted in FIG. 3, and is attached onto the flat plate 31*b* in a posture such that the hole 552*c* of the cylindrical pipe 552*b* in the sensor unit 552 depicted in FIG. 5A is directed vertically downward.

Figure 5C:
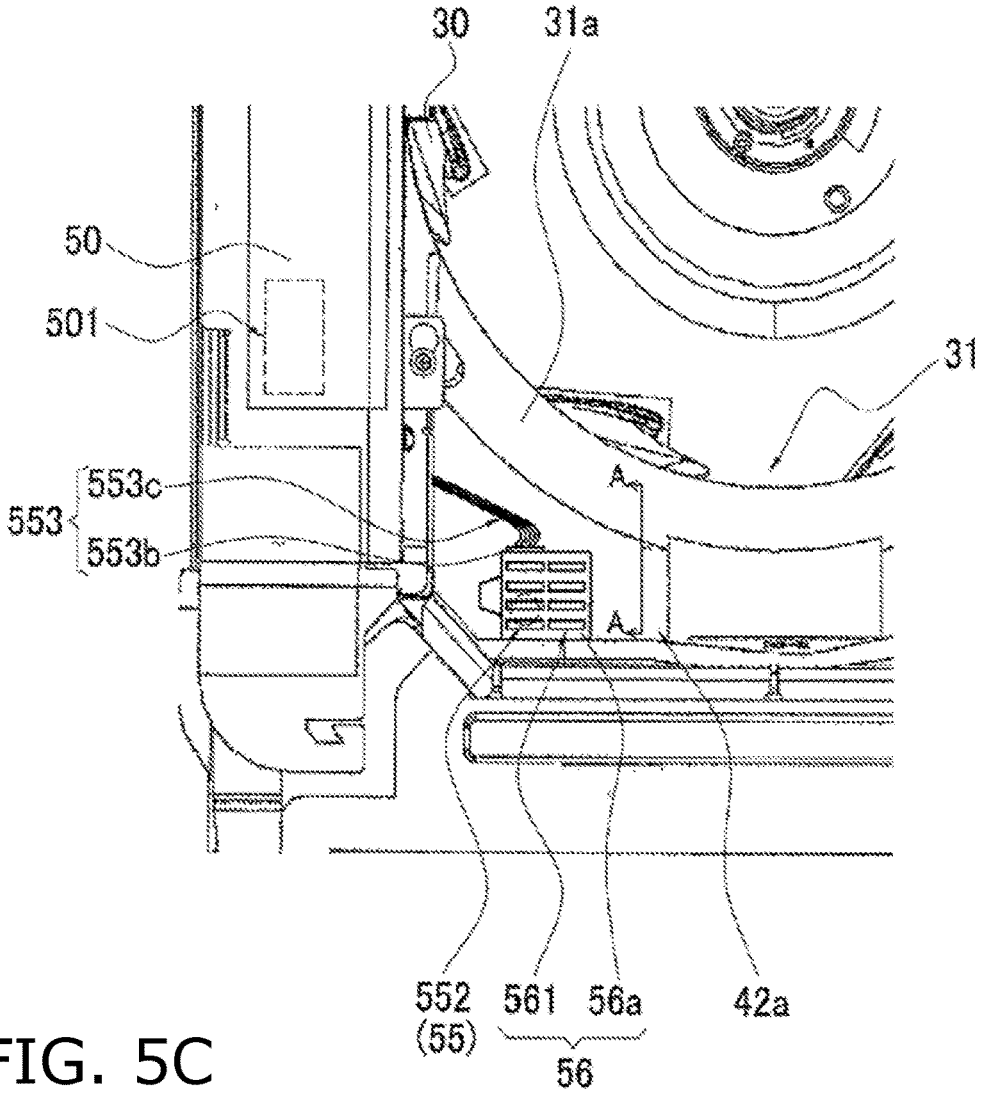
FIG. 5C is an enlarged plan view of a location of the gas sensor.
Figure 5D:
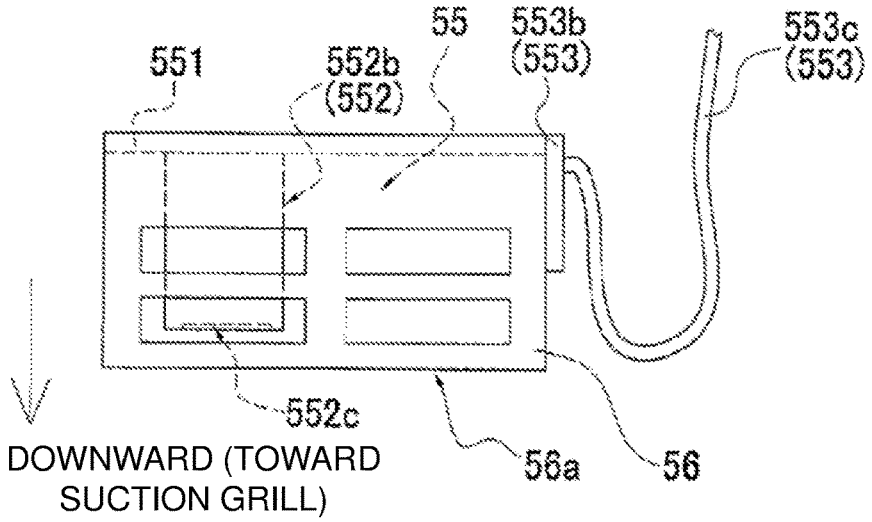
FIG. 5D is a side view, along arrow A indicated in FIG. 5C, of the gas sensor.

FIG. 5C is an enlarged plan view of a location of the gas sensor 55. FIG. 5D is a side view, along arrow A indicated in FIG. 5C, of the gas sensor 55. In FIG. 5C and FIG. 5D, the ventilation surface 56*a* of the case 56 faces the suction grill 60 and is disposed along an opening plane of the blow-in port 42*a*.

As depicted in FIG. 5D, the cable 553*c* of the wiring unit 553 is curved to be positioned below the sensor unit 552 and is then introduced into the electric component box 50. This configuration prevents any waterdrop adhering to the cable from permeating the substrate 551 along the cable 553*c*.

(3-2) Operation of Gas Sensor 55

Most of a refrigerant leaking from the indoor heat exchanger 32 accumulates at the drain pan 36, and refrigerant gas as a leaking refrigerant overflown therefrom flows beyond the bell mouth 31 and out of the blow-in port 42*a* to spread to a border between the body 21 and the decorative panel 40.

The refrigerant gas is blocked by the filter 45 to fill a space between the flat plate 31*b* and the filter 45. At the gas sensor 55, the refrigerant gas flows from the ventilation surface 56*a* of the case 56, reaches the sensor unit 552 via the first openings 561, and enters the cylindrical pipe 552*b* via the hole 552*c* of the cylindrical pipe 552*b* to come into contact with the sensor element 552*a*.

The sensor element 552*a* outputs different voltage values before and after the refrigerant gas comes into contact with the sensor element 552*a*. The microcomputer MC accordingly determines that refrigerant leakage has occurred in accordance with change in signal voltage inputted to the control board 501 via the wiring unit 553.

(3-3) Maintenance of Gas Sensor 55

As depicted in FIG. 2, FIG. 3, FIG. 4A, and FIG. 4B, the electric component box 50 and the gas sensor 55 are installed below the bell mouth 31 and above the filter 45. As depicted in FIG. 2 and FIG. 3, the electric component box 50 and the gas sensor 55 are disposed within a lateral width of the opening 41*a*. When a user or a service person detaches the suction grill 60 from the opening 41*a* and further detaches the filter 45, the electric component box 50 and the gas sensor 55 are thus positioned to be visible by the user or the service person and be reached by a hand of the user or the service person.

As described above, the gas sensor 55, according to one or more embodiments, is attached at a position facilitating attachment of the gas sensor 55 with excellent maintainability.

(4) Characteristics (4-1)

In the indoor unit 20 of the air conditioner 10, the gas sensor 55 configured to detect refrigerant leakage is positioned to be removable when the suction grill 60 is shifted. A user or a service person can thus easily attach and detach the gas sensor 55 with excellent maintainability.

(4-2)

In the indoor unit 20 of the air conditioner 10, the drain pan 36 has the first surface 36*a* facing the bottom of the indoor heat exchanger 32 and the second surface 36*b* other than the first surface 36*a*, and the gas sensor 55 is installed at the second surface 36*b*.

(4-3)

In the indoor unit 20 of the air conditioner 10, the drain pan 36 is installed around the bell mouth 31.

(4-4)

In the indoor unit 20 of the air conditioner 10, the end part 32*a* of the indoor heat exchanger 32 is disposed at the first corner 221 among the plurality of corners of the casing 22, and the electric component box 50 is installed along at least one of the first long side wall 22*b* and the fourth long side wall 22*h* forming the first corner 221.

(4-5)

In the indoor unit 20 of the air conditioner 10, the filter 45 is installed between the blow-in port 42*a* and the suction grill 60. The gas sensor 55 is exposed when the filter 45 is detached, and a user or a service person can thus easily attach and detach the gas sensor 55 with excellent maintainability.

(4-6)

In the indoor unit 20 of the air conditioner 10, a plurality of gas sensors 55 is installed at or adjacent to the electric component box 50.

(4-7)

In the indoor unit 20 of the air conditioner 10, the gas sensor 55 is covered with the case 56 having the first openings 561 for ventilation, and the case 56 exerts two functions of protecting the sensor unit 552 and introducing refrigerant gas as a leaking refrigerant.

(4-8)

In the indoor unit 20 of the air conditioner 10, the ventilation surface 56*a* of the case 56 is provided with the first openings 561. The ventilation surface 56*a* faces the suction grill 60.

(4-9)

In the indoor unit 20 of the air conditioner 10, the side surface 56*b* of the case 56 is provided with the second openings 562. When a refrigerant leaks, part of refrigerant gas entered via the first openings 561 can flow to the sensor unit 552 of the gas sensor 55 and the remaining can exit via the second openings 562. Alternatively, when a refrigerant leaks, part of refrigerant gas entered via the second openings 562 can flow to the sensor unit 552 of the gas sensor 55 and the remaining can exit via the first openings 561.

(5) Modification Examples (5-1) First Modification Example

As described above, one or more embodiments include the single gas sensor 55. However, the present disclosure should not be limited to embodiments with a single gas sensor. Alternatively, the indoor unit 20 may further include a plurality of gas sensors 55 that is installed at a plurality of different positions.

Figure 6A:
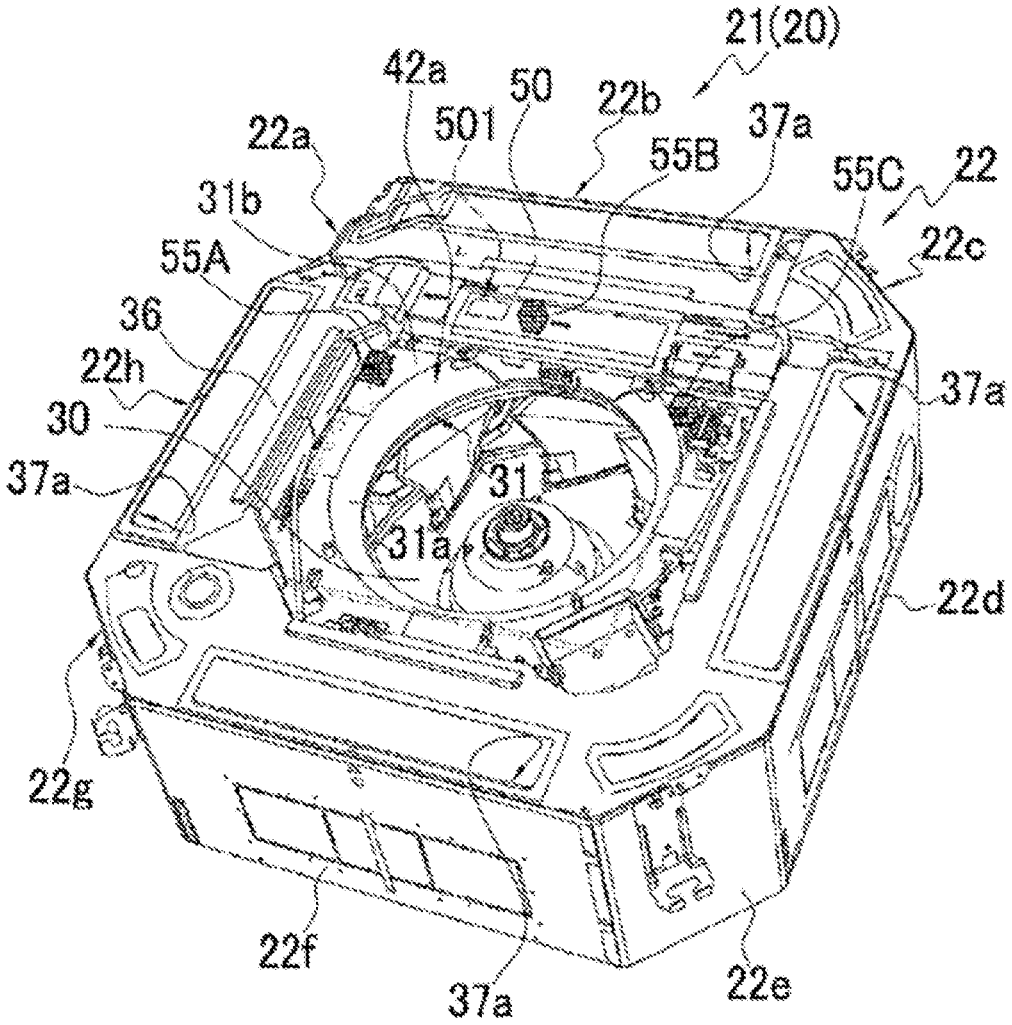
FIG. 6A is a perspective view from below, of an indoor unit according to a first modification example, with a decorative panel being detached.

FIG. 6 is a perspective view from below, of the indoor unit 20 according to the first modification example, with the decorative panel 40 being detached, depicting locations of the plurality of gas sensors 55 being installed. FIG. 6 depicts three gas sensors 55 being installed.

For easier description, assume that the three gas sensors 55 include a first gas sensor 55A, a second gas sensor 55B, and a third gas sensor 55C. The first gas sensor 55A is installed at the second surface 36*b* of the drain pan 36, at a position adjacent to the electric component box 50 and also adjacent to the end part 32*a* of the indoor heat exchanger 32. The second gas sensor 55B is installed at a center of the surface, facing the suction grill 60, of the electric component box 50. The third gas sensor 55C is installed at the second surface 36*b* of the drain pan 36, at a position adjacent to the electric component box 50 and farther than the first gas sensor 55A from the end part 32*a* of the indoor heat exchanger 32.

A refrigerant leaking from the indoor heat exchanger 32 accumulates at the drain pan 36, and refrigerant gas as a leaking refrigerant overflown therefrom flows beyond the bell mouth 31 and out of the blow-in port 42*a* to spread to a border between the body 21 and the decorative panel 40. The gas sensor 55 is thus ideally installed to surround the arc plate 31*a* of the bell mouth 31. However, in view of economic efficiency and maintainability, the plurality of gas sensors 55 is desirably installed at or adjacent to the electric component box 50 as described above.

(5-2) Second Modification Example

The above first modification example exemplifies the locations of the plurality of gas sensors 55, though there is no need to simultaneously use all the gas sensors 55 thus installed. With exemplary reference to FIG. 6A, only the first gas sensor 55A may be used initially and the second gas sensor 55B may be switchingly used before the first gas sensor 55A terminates its durability life cycle.

The first gas sensor 55A can be switched at timing that can be exemplarily determined in accordance with guarantee years of the gas sensor 55A. The first gas sensor 55A may alternatively be switched to a subsequent gas sensor 55 when abnormality different from refrigerant leakage is assumed in accordance with an output signal of the first gas sensor 55A.

In a similar manner, the second gas sensor 55B and the third gas sensor 55C may be used in this order.

(5-3) Third Modification Example

Figure 6B:
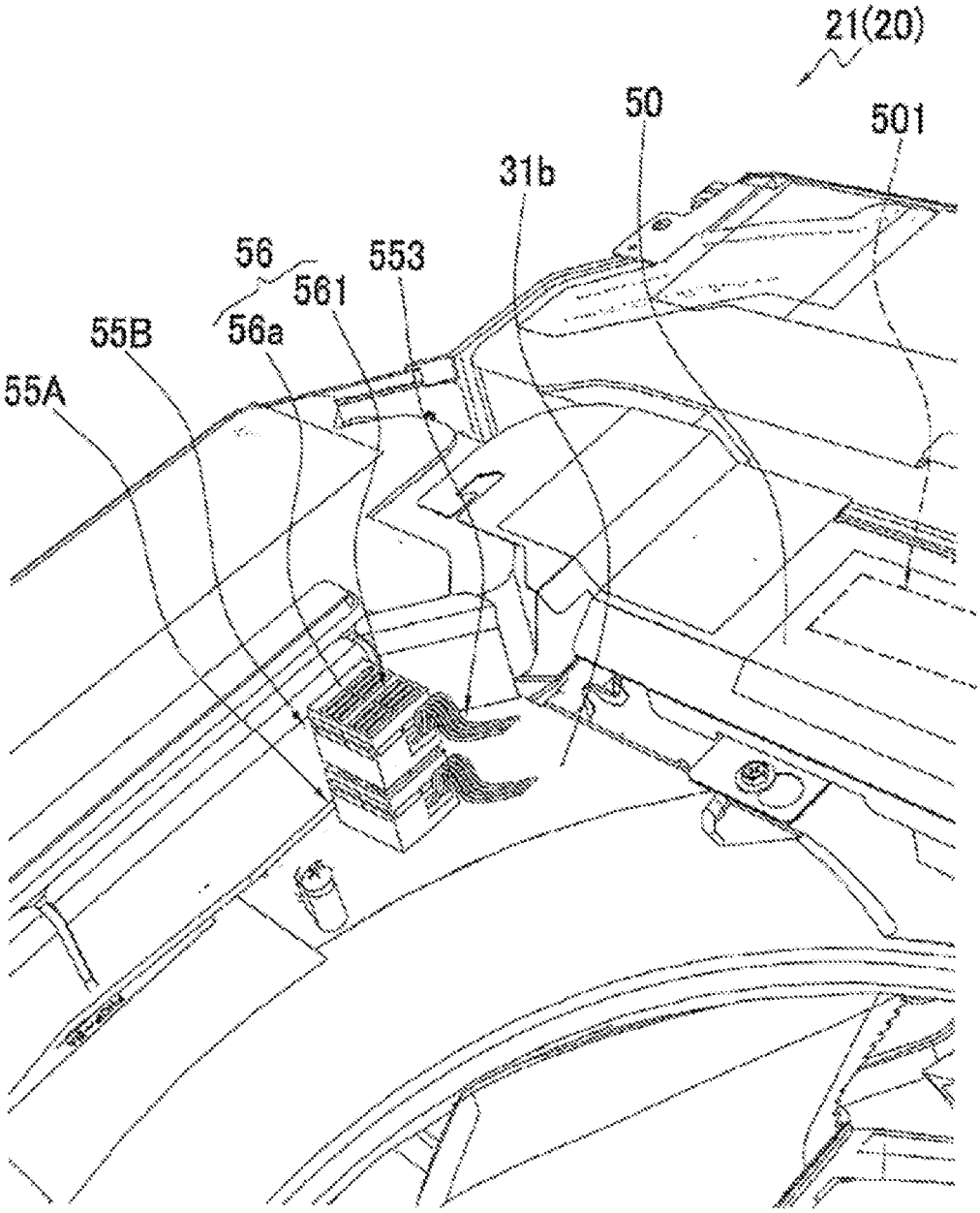
FIG. 6B is a partial enlarged perspective view from below, of an indoor unit according to a third modification example, with a decorative panel being detached.

The plurality of gas sensors 55 may alternatively be installed vertically. FIG. 6B is a perspective view from below, of the indoor unit 20 according to the third modification example, with the decorative panel 40 being detached, depicting locations of the first gas sensor 55A and the second gas sensor 55B. The first gas sensor 55A and the second gas sensor 55B depicted in FIG. 6B are installed vertically.

Assumed examples of a method of use include a first use case of connecting each of the first gas sensor 55A and the second gas sensor 55B to the control board 501, and a second use case of connecting only one of the gas sensors.

(5-3-1) First Use Case

According to the first use case, either one of the first gas sensor 55A and the second gas sensor 55B installed vertically detects any refrigerant leakage. Even in a condition where any one of the gas sensors is in trouble, the remaining gas sensor detects refrigerant leakage. This configuration achieves quick detection of refrigerant leakage.

Furthermore, according to the first use case, after elapse of a predetermined period from occurrence of refrigerant leakage, all the gas sensors operating normally detect refrigerant leakage. Any gas sensor not detecting refrigerant leakage after elapse of the predetermined period can thus be determined as being abnormal.

(5-3-2) Second Use Case

According to the second use case, only the first gas sensor 55A of the first gas sensor 55A and the second gas sensor 55B is connected to the control board 501 to be in use, whereas the remaining gas sensor is not in use.

When the first gas sensor 55A is in trouble, a user or a service person has only to connect, in place of the first gas sensor 55A, the second gas sensor 55B stored below the first gas sensor 55A to the control board 501 to complete replacement of the gas sensor.

The user or the service person can thus replace the gas sensor even when visiting for repair without carrying any gas sensor for replacement.

(6) Others (6-1)

One or more embodiments and the modification examples described above exemplify the case where installation conditions of the gas sensor 55 are applied to an indoor unit of a ceiling embedded type for full blowoff. However, the present disclosure should not be limited to this case. The installation conditions are exemplarily applicable also to an indoor unit of the ceiling embedded type for four-way blowoff, and an indoor unit of the ceiling embedded type for two-way blowoff.

(6-2)

One or more embodiments and the modification examples described above have no limitation in terms of a refrigerant enclosed in the refrigerant circuit C. All refrigerants, irrespective of incombustible refrigerants or combustible refrigerants, can be adopted. In view of safety, one or more embodiments and the modification examples described above are useful to combustible refrigerants.

Examples of the combustible refrigerant include refrigerants categorized in Class 3 (higher flammability), Class 2 (lower flammability), and Subclass 2L (slight flammability) in the standards according to ASHRAE 34 Designation and safety classification of refrigerant in the U.S.A. or the standards according to ISO 817 Refrigerants—Designation and safety classification.

Exemplarily adopted as the combustible refrigerant is any one of R1234yf, R1234ze(E), R516A, R445A, R444A, R454C, R444B, R454A, R455A, R457A, R459B, R452B, R454B, R447B, R32, R447A, R446A, and R459A.

One or more embodiments and one or more modification examples described above adopt R32 as a refrigerant.

(6-3)

One or more embodiments and the modification examples described above refer to the air conditioner as an exemplary refrigeration apparatus. However, the present disclosure should not be limited to this case. Examples of the refrigeration apparatus include, as well as the air conditioner, a low temperature warehouse storing articles that need to be frozen, refrigerated, or kept at low temperature.

(6-4)

In the case 56, according to one or more embodiments and the modification examples described above, the ventilation surface 56*a* facing the suction grill 60 is provided with the first openings 561, and the side surface 56*b* crossing the ventilation surface 56*a* is provided with the second openings 562.

The first openings 561 and the second openings 562 are disposed in a mode that should not be limited to the above. For example, the ventilation surface 56*a* is provided with the plurality of first openings 561, part of which may serve as a refrigerant gas inflow port and the remaining may serve as a refrigerant gas outflow port. The second openings 562 in the side surface 56*b* can be eliminated in this case.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

EXPLANATION OF REFERENCES

10: air conditioner (refrigeration apparatus)
20: indoor unit
22: casing
31: bell mouth
32: indoor heat exchanger
32*a*: end part
36: drain pan
36*a*: first surface
36*b*: second surface
37*a*: blow-out port
42*a*: blow-in port
45: filter
50: electric component box (support member)
55: gas sensor
56: case
56*a*: ventilation surface
56*b*: side surface
60: suction grill (plate-shaped member)
221: first corner
501: control board
561: first opening
562: second opening

CITATION LIST

Patent Literature

Patent Literature 1: JP 2019-11914 A

What is claimed is:

1. An indoor unit of a refrigeration apparatus to be installed in a ceiling, the indoor unit comprising:
- a casing that has blow-out ports and a blow-in port disposed in a lower surface;
- a plate-shaped member disposed below the blow-in port; and
- a filter disposed above an opening in the plate-shaped member, wherein
- the casing accommodates:
  - a heat exchanger in which a refrigerant, with a specific gravity larger than air, flows;
  - a control board;
  - a support member supporting the control board; and
  - a gas sensor disposed at or adjacent to the support member and between the casing and the plate-shaped member, wherein
    - the gas sensor detects the refrigerant flowing out of the blow-in port due to refrigerant leakage, and
    - the gas sensor is removable when the plate-shaped member is shifted,
- the indoor unit further comprises a drain pan disposed below the heat exchanger,
- the gas sensor is disposed underneath a bottom surface of the drain pan, and
- the drain pan overlaps the gas sensor in a vertical direction when the indoor unit is installed in the ceiling.

2. The indoor unit of the refrigeration apparatus according to claim 1, the indoor unit further comprising:

a bell mouth guiding air introduced via the blow-in port, wherein the drain pan is disposed around the bell mouth.

3. The indoor unit of the refrigeration apparatus according to claim 1, wherein the casing has side walls that form corners, including a first corner where an end part of the heat exchanger is disposed, and the support member is disposed along at least one of the side walls forming the first corner of the casing.

4. The indoor unit of the refrigeration apparatus according to claim 1, wherein the filter is disposed between the blow-in port and the plate-shaped member.

5. The indoor unit of the refrigeration apparatus according to claim 1, the indoor unit further comprising:

one or more additional gas sensors disposed at or adjacent to the support member.

6. The indoor unit of the refrigeration apparatus according to claim 1, wherein the gas sensor is covered with a case that has a first opening for ventilation.

7. The indoor unit of the refrigeration apparatus according to claim 6, wherein the case has a ventilation surface facing the plate-shaped member, and the first opening is disposed in the ventilation surface.

8. The indoor unit of the refrigeration apparatus according to claim 6, wherein the case has a side surface that has a second opening.

9. The indoor unit of the refrigeration apparatus according to claim 1, wherein the gas sensor changes an output voltage value in response to contacting refrigerant gas, and the gas sensor is disposed between a bottom face of the heat exchanger and the plate-shaped member.

10. The indoor unit of the refrigeration apparatus according to claim 1, wherein the gas sensor comprises:

a cylindrical pipe that covers a sensing element of the gas sensor.

* * * * *